US006299365B1

(12) United States Patent
Harris et al.

(10) Patent No.: US 6,299,365 B1
(45) Date of Patent: Oct. 9, 2001

(54) DUPLEX CHECK PRINTER USING A CHECK BENDING ROTOR

(75) Inventors: Richard Hunter Harris; Jeff David Thomas, both of Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/479,300

(22) Filed: Jan. 6, 2000

(51) Int. Cl.[7] ..... B41J 17/00
(52) U.S. Cl. ..... 400/188; 400/634; 347/218
(58) Field of Search ..... 400/188, 634, 400/525, 523; 347/218; 53/54

(56) References Cited

U.S. PATENT DOCUMENTS

| | | | | |
|---|---|---|---|---|
| 4,374,463 | * | 2/1983 | Horino et al. | 53/54 |
| 4,376,364 | * | 3/1983 | Horino et al. | 209/534 |
| 4,483,124 | * | 11/1984 | Horino et al. | 53/54 |
| 4,561,352 | | 12/1985 | Svyatsky et al. | 101/2 |
| 4,932,798 | | 6/1990 | Kardinal et al. | 400/120 |
| 5,326,179 | * | 7/1994 | Fukai et al. | 400/525 |
| 5,410,136 | * | 4/1995 | McIntire et al. | 400/523 |
| 5,533,817 | | 7/1996 | Harris et al. | 400/124.28 |
| 5,558,449 | | 9/1996 | Morgavi | 400/188 |
| 5,677,722 | | 10/1997 | Park | 347/218 |
| 5,709,484 | * | 1/1998 | Dorner | 400/188 |
| 5,746,526 | | 5/1998 | Hirose | 400/619 |
| 5,806,999 | * | 9/1998 | Kobayashi | 400/188 |
| 5,865,547 | | 2/1999 | Harris et al. | 400/578 |
| 5,959,278 | * | 9/1999 | Kobayashi et al. | 347/218 |
| 5,962,832 | * | 10/1999 | Dorner | 347/218 |

* cited by examiner

*Primary Examiner*—Eugene Eickholt
(74) *Attorney, Agent, or Firm*—Ronald V. Davidge; J. Bruce Schelkopf

(57) ABSTRACT

A printer for printing on both sides of a document, such as a check being printed at a point of sale terminal, uses a single printing station to print on both sides of the document. The document is moved along a document path and past the printing station, with the first side of the document being printed, with an end portion of the document then being positioned to extend through a slot within a rotor. The rotor is then turned through a 180-degree angle in a first direction, with an end portion of the document being held within the rotor and wrapped around a segment of the rotor. This end portion is next driven back to the printing station for the second side of the end portion to be printed upon. Then the end portion is driven away from the printing station, as the other end of the document is pulled through the rotor. Finally, the rotor is returned by rotation through 180-degrees opposite the first direction.

16 Claims, 2 Drawing Sheets

DUPLEX CHECK PRINTER USING A CHECK BENDING ROTOR

BACKGROUND OF THE INVENTION

1. Field of the Invention

This invention relates to a means for printing on printing on both sides of a paper document, and, more particularly, to printing automatically on both sides of a check at a point of sale terminal with a single print mechanism.

2. Description of the Related Art

In continuing attempts to provide more efficient and convenient service to customers, many retailers have begun to use "point of sale check printers" to reduce the time required for a customer to fill out and sign a check. Such a printer automatically enters the date, amount of purchase, and the name of the retail establishment, to which payment is being made, in the corresponding spaces of a check provided by the customer. The signature line is left blank, for the customer to sign after he has been presented with the printed check.

Another form of printing performed on a check by the retailer is the printing of franking information on the reverse side of the check. This information generally indicates that the check is for deposit only or that it is to be deposited only to a particular account. While it is not necessary to perform this printing operation at the point of sale, many retail establishments have a policy of printing this information, with a rubber stamp if necessary, at the point of sale, reducing the possibility of unrecoverable losses from checks stolen without franking information, which are later stamped or printed with forged information. It is therefore desirable for a point of sale check printer to be able to print on both sides of the check, with the amount of the check and the name of the retail establishment being printed on the front side of the check, and with the franking information being printed on the reverse side.

One method for printing on both sides of a check simply places an additional burden on the cashier using the point of sale terminal. The check is inserted into the printer for printing on a first side, removed, turned over, and then inserted into the printer for printing on the second side. While this method is the simplest in terms of-the hardware required, the additional operations required to be performed by the cashier increase the time required for a transaction while also reducing the chance that the printing operation will be performed correctly. U.S. Pat. No. 5,533,817 provides an example of a printer configured for this type of operation, being capable of printing in either direction, across the width of a document, as needed for printing the franking information, or along its length, as required for printing information on the front side of a check. What is needed in this printer is a way for moving the document so that printing can occur on both sides without removal and reinsertion.

Some printers, such as the printer described in U.S. Pat. No. 5,558,449, provide for printing on both sides of a sheet of paper with two separate print mechanisms, operating on opposite sides of the sheet of paper. However, this approach naturally increases the complexity of the printer mechanism while tending to reduce its reliability.

U.S. Pat. No. 4,561,352 describes apparatus for printing on either side of a document, but not on both sides, in a single pass of the document through the apparatus. This apparatus is configured to print on envelopes, with the operator viewing the information on the front of the document, and with the apparatus then printing information keyed by the operator, such as a bar code representing the zip code or a routing code, on either the front or the back of the envelope. The print module includes two parallel document paths and a print head between the document paths. The print module is manually positioned between a first position, in which first document path is aligned with input and output paths of the apparatus, with the print head facing the first document path, and a second position, in which the second document path is aligned with the input and output paths of the apparatus, with the print head facing the second document path. A rack moving with the first and second document paths causes the print head to rotate between positions facing each of the document paths as the print module is moved.

The apparatus of U.S. Pat. No. 4,561,352 is not well suited for many applications, such as the printing of checks at a point of sale terminal, because a means is needed for moving a document between the two document paths to print on both sides of the document in a single pass through the apparatus, and because the apparatus is too large to fit in available space.

U.S. Pat. No. 4,932,798 describes a thermal transfer printer for printing on both sides of a document, which is carried past a print head while lying against a partial circumference of a print roller. In a first printing operation, a document fed from an input stack is printed on a first side and pulled through a 180-degree angle in contact with the print roller to be driven along a sheet seating surface. In a second printing operation, the document is fed from the sheet seating surface to be printed on the second side as it is again pulled through a 180-degree angle in contact with the print roller. A deflector plate is lowered so that, as the second printing operation is being completed, the document is fed into an output tray instead of being driven along the sheet seating surface.

U.S. Pat. No. 5,677,722 describes a thermal transfer printer capable of printing on both sides of a document. The printer includes first and second transferring rollers, first and second guide paths, and a paper-ejection path. The document is repositioned for printing on the reverse side, after the front side is completely printed by moving the document backward around a loop, with the document being driven through a 180-degree angle before it is again moved past the print head.

U.S. Pat. No. 5,746,526 describes a printer having a paper path feeding paper from a hopper along a "U"-shaped transport path formed of a first linear path, a curved path, and a second linear path. The print head prints on a front surface of the paper as it moves along the first linear path. Then the print head withdraws to a position adjacent the second linear path, from which the print head prints on the back surface of the paper.

U.S. Pat. No. 5,865,547 describes a print head and check flipper subassembly having a removable flipper cartridge to allow printing on both sides of a check Qr other document in one continuous operation. A check is fed downward, between a print head and platen, with printing occurring on a first side of the check, and into a loop within the flipper cartridge. The check continues around the loop, and is driven out of the loop, having been reversed front to back by being driven through a 180-degree angle in the loop. The check is fed upward between the print head and platen, with printing occurring on a second side of the check, and outward through the slot into which it has been inserted. This patent also describes the use of a Magnetic Ink Character Recognition (MICR) reader to read the characters extending along the lower edge of the check to determine the customer's bank and his account number.

A problem with the apparatus of U.S. Pat. Nos. 4,932,798, 5,677,722, 5,746,526 and 5,865,547 arises from the fact that the document must be driven through a 180-degree angle in a relatively tight loop before printing on the reverse side. Moving a document, such as a check, through such a large angle increases the chance that the document may become distorted, damaged, or jammed within the document path during the printing process. For example, when a document is driven through such a large angle, if one of the document edges extending along the document path moves at a faster speed than the opposite such document edge, the document becomes angularly misaligned in a manner which may cause information subsequently printed on the document to be misaligned and which may cause a paper jam or damage to the document. Furthermore, printers which drive the document through such loops typically drive the document across a number of boundaries between adjacent parts of the document path, establishing places where paper jams can begin, with the document being fed at least as far as twice the length of the longest anticipated check or other document. This length of the document path increases the chances that a paper jam may occur, and further increases the time required for the printing process.

BRIEF SUMMARY OF THE INVENTION

According to a first aspect of the present invention, there is provided a printer for printing on both sides of a document. The printer includes an input slot, a document path, document feed rollers, a printing station, and a rotor. The input slot receives the document, which is then moved, by the document feed rollers, along the document path from the input slot. The printing station extends adjacent a first side of the document path. The rotor extends across the document path, being disposed in the first direction along the document path from the printing station. The rotor engages the document to bend an end of the document through a 180-degree angle as the rotor rotates in a first direction of rotation between an initial rotor position and a final rotor position.

According to a second aspect of the present invention, there is provided a method for printing on both sides of a document. The method includes:

a) driving the document along a document path past a printing station;

b) printing on a first side of the document at the printing station;

c) moving the document so that an end portion of the document engages a rotor;

d) turning the rotor in a first direction between an initial rotor position and a final rotor position, wherein the end portion of the document is wrapped around a portion of the rotor as the rotor is turned, and wherein, after turning the rotor, the end portion extends along the first side of a remaining portion of the document;

e) moving the end portion of the document opposite the first direction into a position adjacent the printing station;

f) printing on a side of the end portion opposite the first side thereof within the printing station.

DETAILED DESCRIPTION OF THE INVENTION

Figure 1:
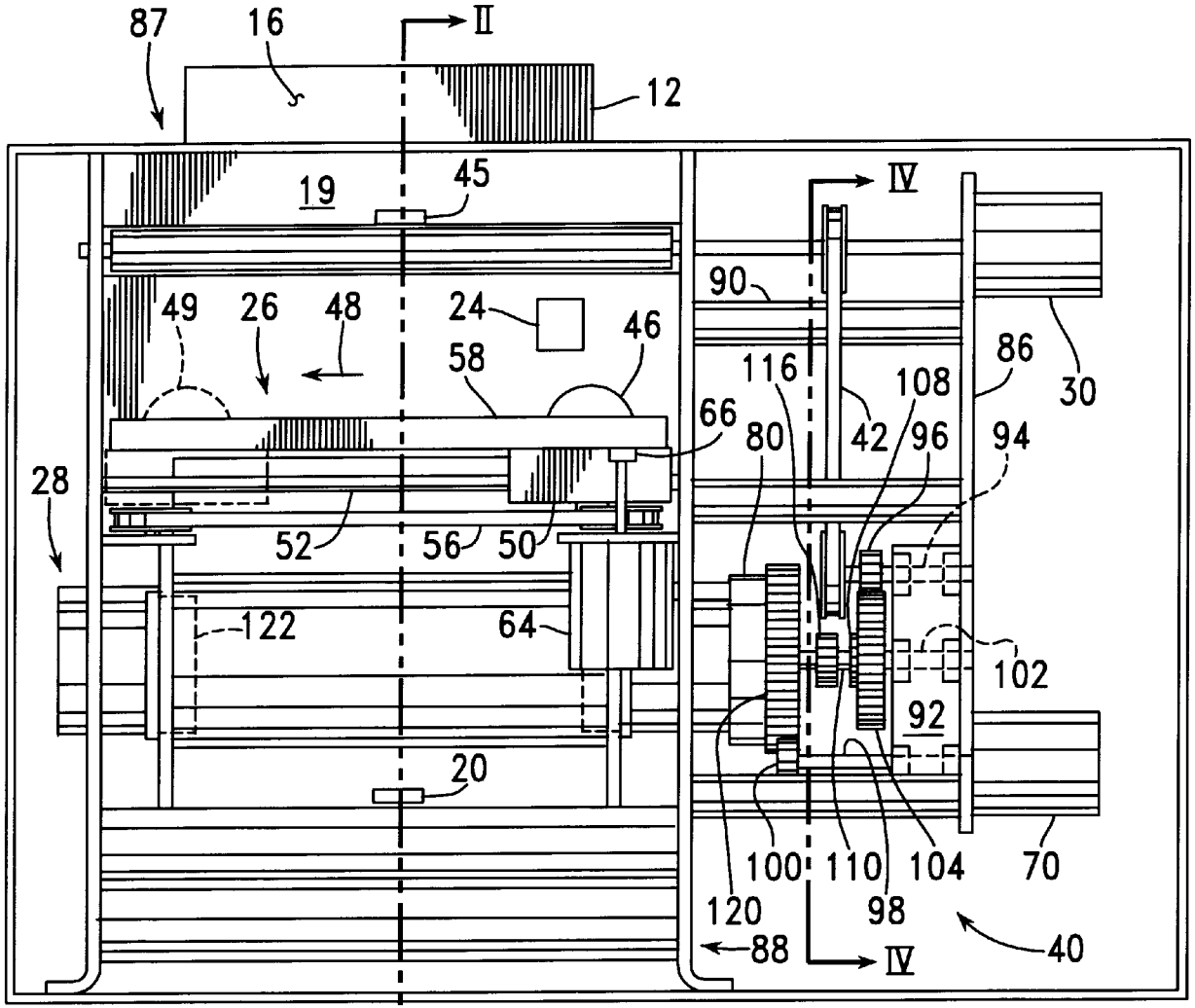
FIG. 1 is a front elevation of a duplex printer built in accordance with a first embodiment of the present invention, shown with a front cover removed to reveal interior structures.
Figure 2:
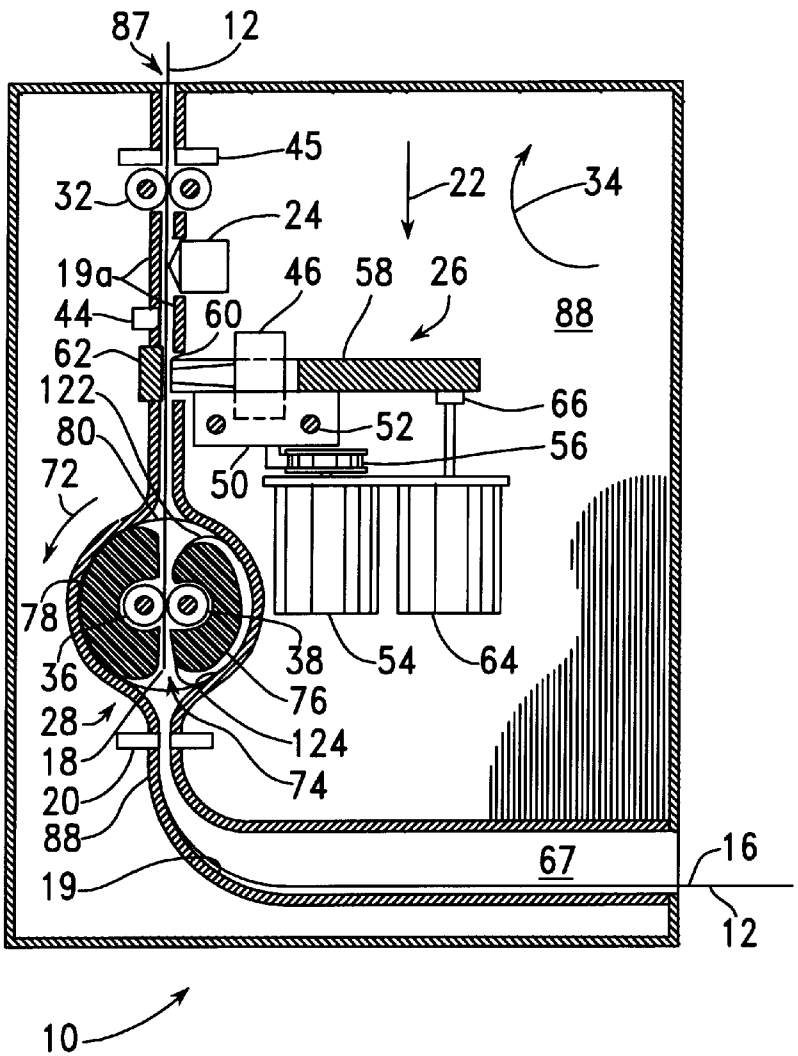
FIG. 2 is a left cross-sectional elevation of the duplex printer of FIG. 1, taken as indicated by section lines II—II in FIG. 1, shown with a check initially inserted within a check bending rotor thereof.

FIGS. 1 and 2 are elevations of a duplex printer 10 built in accordance with a first embodiment of the present invention, with FIG. 1 being a front view of the printer 10, shown with a front cover removed to reveal interior structures, and with FIG. 2 being a right cross-sectional elevation, taken as indicated by section lines II—II in FIG. 1.

Referring to FIGS. 1 and 2, the process of printing information on a check 12 begins when the check 12 is inserted into a input slot 14 at the front of the duplex printer 10, with the front surface 16 of the check facing upward, and with the edge of the check adjacent the location where franking information is to be printed being inserted as a leading edge 18. A number of document guides 19 and 19*a* are used to establish a document path along which the check 12 is moved. After the presence of the check 12 is detected by an input document presence sensor 20, the check 12 is driven upward, opposite the direction of arrow 22, through a check bending rotor 28 and a printing station 26, into engagement with an upper drive roller 32. This upward motion of the check 12 occurs as a document feed motor 30 is turned on to rotate the first lower drive roller 36 opposite the direction opposite arrow 34 and to rotate the second lower drive roller 38 in the direction of arrow 34, and continues due to the motion of an upper drive roller 32 opposite the direction of arrow 34. Lower drive rollers 36, 38 which are driven by the document feed motor 30 through a belt 42, are preferably held together by means of springs (not shown). The magnetic ink characters written along the edge of the check 12 are preferably read by the magnetic read head 24, after these characters are magnetized by movement past a permanent magnet 44, as the check 12 is driven upward for the first time. These magnetic ink characters typically describe the bank and the particular account on which the check is being drawn, providing information which can be compared with data representing stolen checks, and which can possibly be used to determine if there is enough money in the account to pay for the check being prepared.

The document presence sensors 20, 45 in the document feed path are preferably of a well known optical type, having an LED light source on one side of the document path, along which the check 12 is driven, and a photodetector aimed at the light source on the opposite side of the document path. When an edge of the check 14 enters a sensor 20, 45, the light is blocked from the photodetector. In this way, the passage of an edge of the check 14 in either direction is easily detected.

The printing station 26 is preferably of a wire array impact type, having a print head 46 with a linear pattern of printing wires arranged at an angle permitting the generation of printed characters in a line extending lengthwise along the check 12 as the check is moved in and opposite the direction of arrow 22 and also permitting the generation of printed characters in a line extending across the check 12 is held still while the print head 46 is moved laterally, in and opposite the direction of arrow 48, between the position in which it is shown in FIG. 1 and the position indicated by dashed lines 49. This configuration and use of the print head 46 is thoroughly described in U.S. Pat. No. 5,533,817.

Thus, the print head 46 is attached to a carriage 50, sliding on a pair of rails 52, being moved by a carriage drive motor 54 through a toothed belt drive 56. The printing station 26 also includes a ribbon cartridge 58, which is used to supply a printing ribbon 60 extending between the inserted check 12 and print head 46. Printed characters are formed by the impact of individual print wires on the ribbon 60, which causes ink to be transferred from the ribbon 60 to the adjacent surface of the check 12. A platen 62, extending-across the inserted check 12, backs up the printing process so that the forces necessary to effect ink transfer can be developed between the ribbon 60 and the check 12. The ribbon is fed between opposite sides of the ribbon cartridge 58 by means of a ribbon feed motor 64, turning a coupling 66 extending from the ribbon cartridge 58.

In accordance with a preferred version of the present invention, as check 12 is moved upward, opposite the direction of arrow 22, for the first time, the first line of information on the front surface 16 of the check 12 is printed. As the check 12 is subsequently moved downward for the first time, the magnetically encoded characters are read by the magnetic read head 22. Thus, the print head 46 is aligned, in the direction of arrow 48, with the position at which the first line of information is to be printed before the first line is printed. This first line of information is, for example, the date the check is being printed. To this end, the print head 46 is driven into this alignment either at the beginning or at the end of the printing process.

Next, the print head 46 is driven into alignment with the position at which a second line of information is to be printed on the front surface 16. The second line of information is, for example, the name of the retail business to which the check 12 is being offered, together with the monetary amount to be represented by the check 12, written in numerals. This second line of information is now printed as the check 12 is moved upward, opposite the direction of arrow 22.

Next, the print head 46 is driven into alignment with the position at which a third line of information is to be printed on the front surface 16. The third line of information is, for example, the monetary amount to be represented by the check 12, written in words. This third line of information is now printed as the check 12 is again moved downward, in the direction of arrow 22.

The document feed motor 30 is preferably a stepper motor driven by signals which further indicate the angles through which the this motor 30 has been driven since the start of the printing process, following the detection of document insertion by means of a document presence sensor 20, 45. In this way, the actual position of the check 12 is tracked throughout the printing process, with this location information being used to determine the positions on the check 12 at which individual characters are printed. During this printing process, the check 12 is moved upward and downward, being allowed to extend upward from an upper slot 67 and downward into a cavity 14. The check 12 is always controlled by either or both the upper drive roller 32 and the lower drive rollers 36, 38.

When the processes associated with printing information on the front surface 16 of the check 12 have been completed, the check 12 is driven into the position in which it is shown in FIG. 2, with the leading edge 18 of the check 12 extending to a position slightly below the lower drive rollers 36, 38. The check 12 is driven upward or downward into this position, depending on the position of the check 12 when the last line has been printed on its front surface 16. The lower document presence sensor is preferably used to determine when the check 12 has been moved into this position. Next, the rotor drive motor 70 is turned on to cause the check bending rotor 28 to rotate through a 180-degree angle in the direction of arrow 72.

Figure 3:
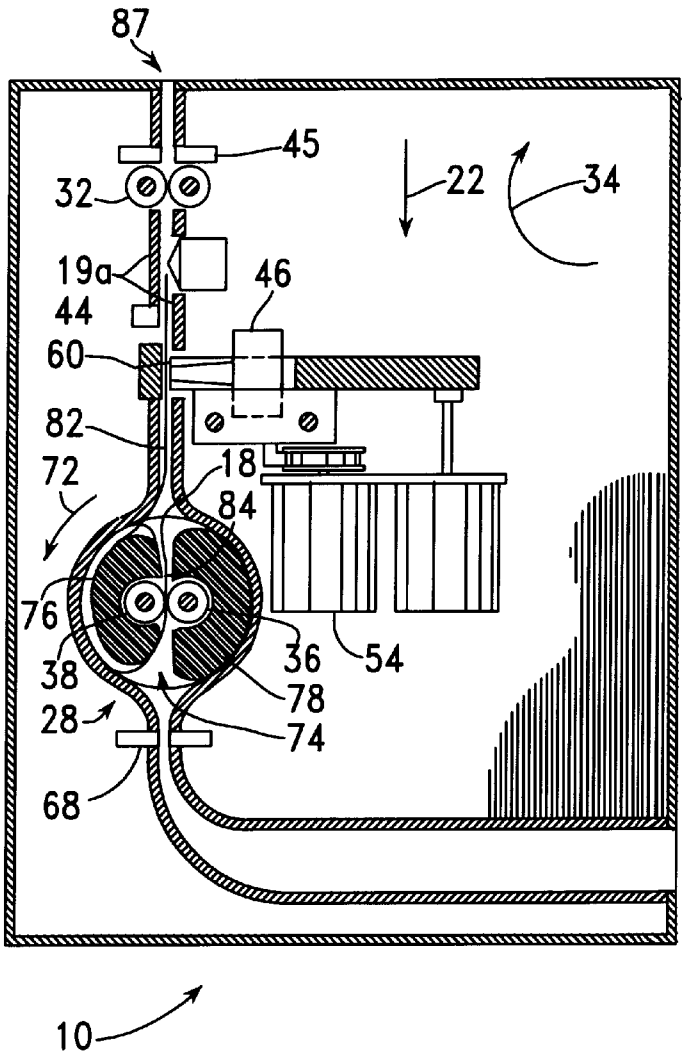
FIG. 3 is a left cross-sectional elevation similar to FIG. 2, except that this view is shown after rotation of the check bending rotor thereof to bend the check inserted therein

FIG. 3 is a cross-sectional elevation of the duplex printer 10 showing the check bending rotor 28 and the check 12 after the rotation of the rotor 28 in the direction of arrow 72. FIG. 3 is otherwise similar to FIG. 2.

Referring to FIGS. 2 and 3, before the rotation of the rotor 28, the check 12 extends within a slot 74 between a wrapping housing section 76 and a support housing section 78, both of which extend from a cylindrical housing section 80. During the rotation of the rotor 28, the check 12 is retained within the slot 74, as an end of the check 12 extending from the leading edge 18 is wrapped around the wrapping housing section 76. During this rotation, the lower drive rollers 36, 38 maintain their position relative to check 12 as the document feed motor 30 is driven to maintain the relationship between these rollers 36, 38 through a gear train to be explained below in reference to FIG. 4

Following the rotation of the rotor 28, the leading edge 18 of the check 12 extends upward, adjacent the opposite end portion 82 of the check 12 extending upward. Continued rotation of the first lower drive roller 36 in the direction of arrow 34, and of the second lower drive roller 38 in the direction opposite that of arrow 34 is used to drive the portion 84 of the check 12 extending upward to the leading edge 18 in an upward direction into position for printing the first line of franking information on the back surface of the check 12. The back surface of this portion 84 is now exposed to the printer ribbon 60 extending between this portion 84 and the print head 46.

Next, with the lower drive rollers 36, 38 remaining stationary to hold the check 12 in place, the print head 46 is moved laterally, in or opposite the direction of arrow 48, by means of the carriage drive motor 54, to print the first line of franking information. Then, the check is moved by means of the lower drive rollers 36, 38 to the location of each additional line of franking information, with such additional lines of franking information being individually printed as the check 12 is held stationary and as the print head is moved laterally. The franking information, which is printed on the check 12 near its leading edge 18, typically indicates that the check 12 is to be deposited in a particular account of the retail establishment receiving the check 12.

After the franking information has all been printed, the portion 84 of the check on which the franking information has been printed extends upward past the upper document feed rollers 32, while the opposite end portion 82 has moved downward from these upper document feed rollers 32. The end portion 84 is then moved upward through the rotation of document feed rollers 32 opposite the direction of arrow 34. As this part of check 12 is driven upward, the trailing edge of the check 12 moves downward, being pulled around wrapping section housing 76, to be subsequently pulled upward between the lower drive rollers 36, 38. The check 12 is then moved upward through the rotation of the upper document feed rollers 32 and outward through a slot 87. The check bending rotor 28 is then driven in the direction of arrow 34 to its initial position in preparation for the next transaction, in which another check will be printed.

The duplex printer 10 works as described above because the document path distance between the upper document feed rollers 32 and the lower document feed rollers 36, 38, with the check bending rotor 28 in the initial position of FIG. 2 and the check 12 extending directly between the upper document feed rollers 32 and the lower document feed rollers 36, is shorter than the length of the shortest check 12 to be printed. If this were not true, the check 12 would reach a central position in which it could not be moved by either the upper document feed rollers 32 or by the lower document feed rollers.

Furthermore, the duplex printer 10 works as described above because the document path distance between the upper document feed rollers 32 and the lower document feed rollers 36,38, with the check bending rotor in the final position of FIG. 3 and with the check 12 extending around the wrapping section housing 76 is longer than the longest check 12 to be printed. Thus, the process or wrapping the check around the wrapping section housing 76 pulls the trailing edge of the check out of contact with the upper document feed rollers 32. Since a substantial portion of the check 12 is wrapped around the wrapping section housing 76, these simultaneous conditions are both met, in spite of variations in the length of checks between the relatively short checks generally used as personal checks and the relatively long checks generally used as business checks.

Figure 4:
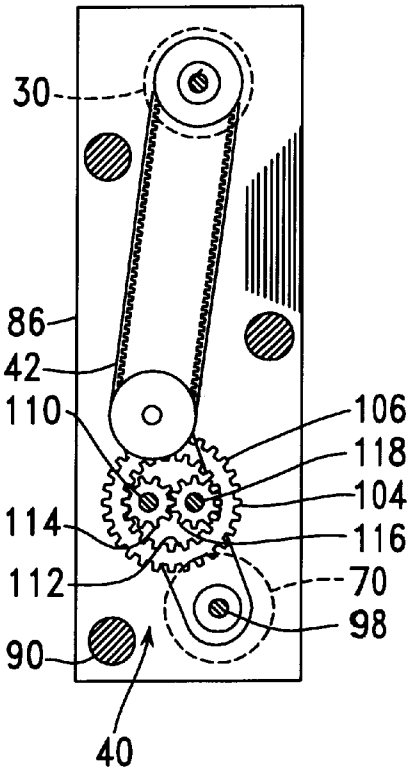
FIG. 4 is a right cross-sectional elevation of the duplex printer of FIG. 1, taken as indicated by section lines IV—IV in FIG. 1 to show a mechanism for driving the check bending rotor thereof.

FIG. 4 is a right cross-sectional elevation of the duplex printer 10, taken as indicated by section lines IV—IV in FIG. 1 to show a mechanism for driving the check bending rotor 28, including the lower drive rollers 36, 38 rotatably mounted within the check bending rotor.

Referring to FIGS. 1 and 4, the two motors associated with moving the check 12, specifically the document feed motor 30 and the rotor drive motor 70, are mounted to a drive plate 86, which is in turn attached to an internal framework 88 of the duplex printer 10 by means of three stand-offs 90. A bearing block 92 extends inward from the drive plate 86, supporting a shaft 94 mounting a lower document feed gear 96, a shaft 98 extending between the rotor drive motor 70 and a rotor drive gear 100, and a shaft 102 extending outward from a ring gear 104.

The lower document feed gear 96 meshes with an outer peripheral gear pattern 106 of the ring gear 104, while a first document feed gear 108 on the shaft 110, extending from the first lower drive roller 36, meshes with an internal gear pattern 112 of the ring gear 104. In this way, the rotational motion of the document feed motor 30 is carried to the first lower drive roller 36 regardless of the position of the first lower drive roller 36 as the rotor 28 is turned. A second document feed gear 114, also attached to the shaft 110, meshes with a third document feed gear 116, attached to a shaft 118, extending from the second lower drive roller 38. In this way, the second lower drive roller 38 is always driven at the same rotational speed as the first lower drive roller 36, but in the opposite rotational direction.

The rotor drive gear 100 meshes with a rotor gear 120 extending around the cylindrical housing section 80 of the rotor 28. Journal bearing structures 122 extending partly around the rotor 78 provide for the capture of the rotor 78 within rotor guiding surfaces 124 of the internal framework 88, while leaving the slot 74 clear to allow the insertion of a document having greater width than that of the check 12.

The present invention has advantages over the prior art devices using a single print mechanism in that the check 12 is not fed through a great distance to accomplish the process of turning the check over, and in that the check 12 is reliably held within the rotor 28 when an end portion 84 of the check is turned over, instead of being fed through a document path having a tight turn and a number of boundaries, at which document jams can occur, between adjacent parts.

While the invention has been described as using a printing station 26 having wire array impact print head 46, it is understood that other types of printing stations may be used within the scope of the present invention. For example, an ink jet print head having a number of nozzles extending across the width of the check 12 could be used to all the information required on each side of the check 12 during a single pass by the print head.

While the present invention has been described in its preferred form or embodiment with some degree of particularity, it is understood that this has been done only by way of example, and that numerous changes, including changes in the arrangement of parts and process steps, may be made without departing from the scope of the invention. For example, the front side of the check may be printed after, rather than before, the end portion of the check is bent, printed, and returned to a flat condition.

What is claimed is:

1. A printer for printing on both sides of a document comprising:

an input slot for receiving said document;

a document path, extending from said input slot, wherein said document is moved along said document path;

document feed rollers moving said document along said document path;

a printing station extending adjacent a first side of said document path;

a rotor, extending across said document path, wherein said rotor is disposed in a first direction along said document path from said printing station, wherein said rotor includes a wrapping housing section, and wherein said rotor engages said document to bend an end of said document through a 180 degree angle around said wrapping housing section as said rotor rotates in a first direction of rotation between an initial rotor position and a final rotor position.

2. The printer of claim 1, wherein said rotor includes a slot through which said document is driven, and said document feed rollers include an upper document feed roller adjacent said input slot and a first lower document feed roller rotating within said rotor in contact with a document extending through said slot in said rotor.

3. A printer for printing on both sides of a document comprising:

an input slot for receiving said document;

a document path, extending from said input slot, wherein said document is moved along said document path;

document feed rollers moving said document along said document path;

a printing station extending adjacent a first side of said document path; and a rotor extending across said document path, wherein said rotor is disposed in a first direction along said document path from said printing station, wherein said rotor engages said document to bend an end of said document through a 180 degree angle as said rotor rotates in a first direction of rotation between an initial rotor position and a final rotor position, and wherein, after said rotor rotates in engagement with said end of said document between said initial rotor position and said final rotor position, said end of said document extends between a remaining portion of said document extending opposite said first direction from said rotor and said first side of said document path.

4. The printer of claim 3, wherein before said rotor rotates in engagement with said end of said document between said initial rotor position and said final rotor position, said printing station prints information on a first side of said document, and after said rotor rotates in engagement with said end of said document between said initial rotor position and said final rotor position, said end of said document is moved into position between said printing station and said remaining portion of said document, and said printing station prints information on said end of said document.

5. The printer of claim 4, wherein, after said printing station prints information on said end of said document, said end of said document is driven away from said rotor, said document is driven out of engagement with said rotor, said rotor is rotated opposite said first direction of rotation between said final rotor position and said initial rotor position.

6. A printer for printing on both sides of a document, wherein said printer comprises an input slot for receiving said document, a document path, extending from said input slot, wherein said document is moved along said document path, document feed rollers moving said document along said document path, a printing station extending adjacent a first side of said document path; and a rotor extending across said document path;

said rotor is disposed in a first direction along said document path from said printing station;

said rotor engages said document to bend an end of said document through a 180 degree angle as said rotor rotates in a first direction of rotation between an initial rotor position and a final rotor position;

said rotor includes a rotor slot through which said document is driven;

said document feed rollers include an upper document feed roller adjacent said input slot and a first lower document feed roller rotating within said rotor in contact with a document extending through said rotor slot in said rotor, a second lower document feed roller adjacent said input slot and adjacent said first lower document feed roller, and said first and second lower document feed rollers are connected to turn in opposite directions.

7. A printer for printing on both sides of a document comprising:

an input slot for receiving said document;

a document path, extending from said input slot, wherein said document is moved along said document path;

document feed rollers moving said document along said document path;

a printing station extending adjacent a first side of said document path; and a rotor extending across said document path, wherein said rotor is disposed in a first direction along said document path from said printing station, wherein said rotor engages said document to bend an end of said document through a 180 degree angle as said rotor rotates in a first direction of rotation between an initial rotor position and a final rotor position, wherein said rotor includes a rotor slot through which said document is driven, a wrapping housing section forming a first side of said rotor slot, wherein said document is wrapped around said wrapping housing section as said rotor rotates between said initial position and said final position, a support housing section forming a second side of said rotor slot, and an end housing section from which said wrapping housing section and said support housing section extend, and wherein said document feed rollers include an upper document feed roller adjacent said input slot and a first lower document feed roller rotating within said rotor in contact with a document extending through said rotor slot in said rotor.

8. The printer of claim 7, additionally comprising:

a rotor gear extending around said end housing;

a rotor driving gear meshing with said rotor gear; and a rotor driving motor rotating said rotor driving gear to rotate said rotor in either direction between said initial position and said final position.

9. The printer of claim 7, additionally comprising:

a ring gear having an axis of rotation coaxial with an axis of rotation of said rotor and an internal gear pattern;

a lower document feed motor driving said ring gear in rotation; and a first lower drive gear attached to a shaft extending from said first lower document feed roller, wherein said lower drive gear meshes with said internal gear pattern of said lower drive gear.

10. The printer of claim 9, additionally comprising a second lower drive gear attached to a shaft extending from said second lower document feed roller, wherein said second lower drive gear meshes with said first lower drive gear.

11. A printer for printing on both sides of a document comprising:

an input slot for receiving said document;

a document path, extending from said input slot, wherein said document is moved along said document path;

document feed rollers moving said document along said document path;

a printing station extending adjacent a first side of said document path; and a rotor extending across said document path, wherein said rotor is disposed in a first direction along said document path from said printing station, wherein said rotor engages said document to bend an end of said document through a 180 degree angle as said rotor rotates in a first direction of rotation between an initial rotor position and a final rotor position, wherein said rotor includes a rotor slot through which said document is driven, and wherein said document feed rollers include an upper document feed roller adjacent said input slot and a first lower document feed roller rotating within said rotor in contact with a document extending through said rotor slot in said rotor, and wherein a document path distance between said upper document feed roller and said first lower document feed roller with said rotor in said initial position is short enough that said document extends in engagement with both said upper document feed roller and said first lower document feed roller.

12. The printer of claim 11, wherein said rotor includes a wrapping housing section forming a first side of said rotor slot, wherein said document is wrapped around said wrapping housing section as said rotor rotates between said initial position and said final position, and a document path distance between said upper document and said first lower document feed roller with said rotor in said final position and said document wrapped around said wrapping housing section is longer than said document.

13. A printer for printing on both sides of a document comprising:

an input slot for receiving said document;

a document path, extending from said input slot, wherein said document is moved along said document path;

document feed rollers moving said document along said document path;

a printing station extending adjacent a first side of said document path; and a rotor extending across said document path, wherein said rotor is disposed in a first direction along said document path from said printing station, wherein said rotor engages said document to bend an end of said document through a 180 degree angle as said rotor rotates in a first direction of rotation between an initial rotor position and a final rotor position, wherein said rotor includes a rotor slot through which said document is driven, and wherein said document feed rollers include an upper document feed roller adjacent said input slot and a first lower document feed roller rotating within said rotor in contact with a document extending through said rotor slot in said rotor, wherein said rotor includes a wrapping housing section forming a first side of said rotor slot, wherein said document is wrapped around said wrapping housing section as said rotor rotates between said initial position and said final position, and wherein a document path distance between said upper document and said first lower document feed roller with said rotor in said final position and said document wrapped around said wrapping housing section is longer than said document.

14. A method for printing on both sides of a document, comprising steps of:

a) driving said document along a document path past a printing station;

b) printing on a first side of said document at said printing station;

c) moving said document so that an end portion of said document engages a rotor;

d) turning said rotor in a first direction between an initial rotor position and a final rotor position, wherein said end portion of said document is wrapped around a portion of said rotor as said rotor is turned, and wherein, after turning said rotor, said end portion extends along said first side of a remaining portion of said document;

e) moving said end portion of said document into a position adjacent said printing station;

f) printing on a side of said end portion opposite said first side thereof within said printing station.

15. The method of claim 14, wherein step f) is followed by steps of:

g) moving said end portion of said document away from said printing station and away from said rotor as said remaining portion of said document is pulled through said rotor; and h) turning said rotor opposite said first direction between said final rotor position and said initial rotor position.

16. The method of claim 15 wherein step c) includes moving said end portion of said document between a pair of document feed rollers turning within said rotor.

* * * * *